United States Patent [19]

Zavatone

[11] Patent Number: 5,009,363

[45] Date of Patent: Apr. 23, 1991

[54] BRIDGE SEPARATED TRAY AND BLANK FOR FORMING IT

[76] Inventor: James F. Zavatone, 109 N. Mid America Mall, Apt. 1511, Memphis, Tenn. 38103

[21] Appl. No.: 493,652

[22] Filed: Mar. 15, 1990

[51] Int. Cl.[5] ..... B65D 5/48

[52] U.S. Cl. ..... 229/120.17; 229/114; 229/120.16

[58] Field of Search ..... 229/113, 114, 120.16, 229/120.17, 902, 906; 206/561

[56] References Cited

U.S. PATENT DOCUMENTS

| | | | |
|---|---|---|---|
| 811,676 | 2/1906 | Vernon | 229/120.17 |
| 1,170,776 | 2/1916 | Nagle | 229/120.16 |
| 1,465,231 | 8/1923 | Oglesby | 229/120.17 |
| 2,214,525 | 9/1940 | Murguiondo | 229/120.17 |
| 2,706,075 | 4/1955 | Buttery | 229/120.17 |
| 3,863,832 | 2/1975 | Gordon et al. | 229/903 |
| 3,876,132 | 4/1975 | Kuchenbecker | 229/120.17 |
| 4,192,443 | 3/1980 | McLaren | 229/120.17 |
| 4,301,960 | 11/1981 | Alexander et al. | 229/120.17 |
| 4,848,648 | 7/1989 | Eisman | 229/120.17 |
| 4,905,889 | 3/1990 | Schuster | 229/120.17 |

*Primary Examiner*—Gary E. Elkins

*Attorney, Agent, or Firm*—Walt Thomas Zielinski

[57] ABSTRACT

A tray formed from a unitary paperboard blank. The tray has at least one pair of parallel troughs whose ends are closed by end forming flaps carried by the trough bottoms. A longitudinal arch in the general form of an inverted V in transverse cross section separates the troughs and forms one side of each. The uppermost portions of the ends of the arch extend through the ends of the tray. In one embodiment, the top of the arch is sharp in transverse cross section, while in a second embodiment, the top of the arch is truncated. In the third embodiment, the tray has three parallel troughs.

11 Claims, 5 Drawing Sheets

BRIDGE SEPARATED TRAY AND BLANK FOR FORMING IT

BACKGROUND OF THE INVENTION

This invention relates to a tray construction and more particularly to a tray fashioned from the unitary blank of stiff, resilient and foldable material such as paperboard.

This art is aware of trays including at least a pair of parallel troughs, with the troughs being connected together along their adjacent longitudinal edges. A variety of such constructions is known and while each has apparently been satisfactory, there exists a requirement for a tray having parallel troughs which can be fashioned from a single sheet of paperboard and which is relatively easy to set up or erect and also is rigid.

SUMMARY OF THE INVENTION

According to the practice of this invention, a tray is fashioned from a unitary blank of paperboard or other stiff, foldable and resilient material, with the construction being such that a bridge or arch separates two adjacent parallel troughs of the tray. The arch is formed by meeting sides of the troughs and is somewhat longer than the bottom of the troughs and the troughs end walls, thereby causing the extra arch length to support and become a part of the end structure for the tray by extending through the tray end walls. This construction not only facilitates tray assembly but strengthens and rigidifies the tray. The blank from which the tray is formed includes a plurality of parallel, serially arranged, elongated panels foldably joined to each other along their respective elongated sides.

DETAILED DESCRIPTION OF THE INVENTION

Figure 1:
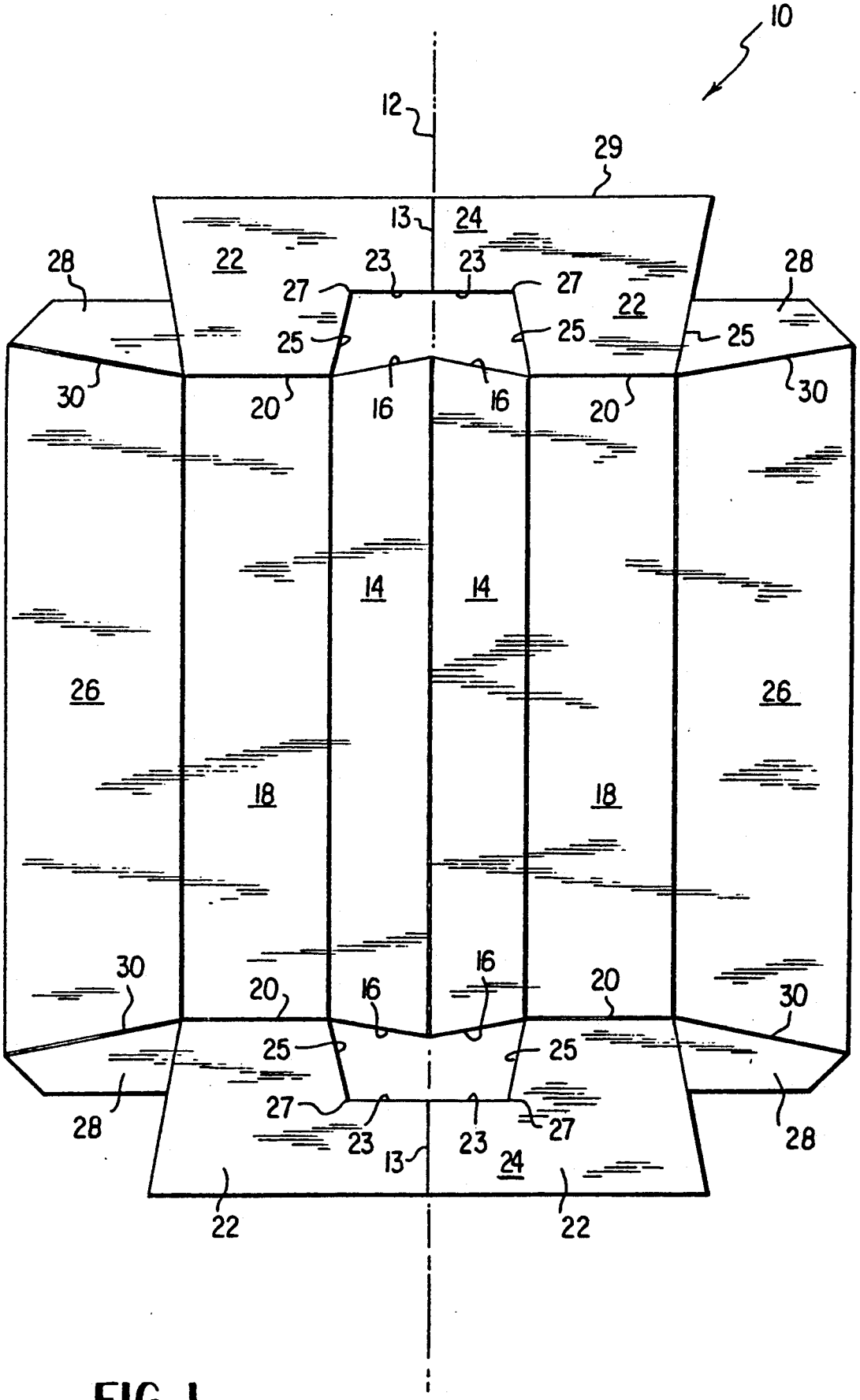
FIG. 1 is a plan view of a paperboard blank from which the tray of this invention is fashioned.

Referring now to FIG. 1 of the drawings, the numeral 10 denotes generally a paperboard blank from which the tray of this invention is erected, the blank preferably being cut as by dies to the indicated configuration, with the several panels of the blank defined by conventional fold and cut lines. The numeral 12 denotes a longitudinal axis of mirror symmetry and in this blank configuration is coincident with one of the fold lines.

The blank includes a plurality of parallel, serially arranged, main panels some of which are rectangular and some of which are trapezoided, joined to each other by fold lines. The upper and lower ends of some of the main panels are foldably connected to end wall forming flaps.

A first trapezoidal panel is denoted by 14, with its free, short edges 16 slanting as indicated. It will be seen that two adjacent first main panels 14, define a generally central longitudinal section of the entire blank, with the section being convex at free edges 16. Panels 14 are arch or partition forming panels.

A generally rectangular trough bottom forming and second main panel 18 is foldably connected along one its longitudinal edges to a respective panel 14, with panel 18 having a fold line 20 at each of its short edges, the latter coupling end wall forming flaps or panels 22 thereto. Each end wall forming flap 22 is angled, being generally L shaped in this embodiment, with one leg of the L denoted as 24. This latter leg portion extends towards and has one of its free edges terminating at cut 13, coincident with axis 12. It will be observed that the other leg of the L shaped flaps 22 are divergent, having sloping edge portions 25 which meet, at 27, free edges 23 of each leg 24. The free edge 16 of each trapezoidal panel 14 is at an angle to the fold axis 20 of each adjacent panel 18.

A third main panel is denoted as 26 and carries a glue tab 28, integrally connected at each end of each panel 26 by fold line 30 which is slanted with respect to fold axis 20 of each adjacent panel 18. Main panel 26 is also trapezoidal.

It will be observed that the slope or tilt of each free edge 16 of first panel 14 is the same as the tilt of each fold line 30, as referred to an axis colinear with fold lines 20 of panels 18.

Figure 2:
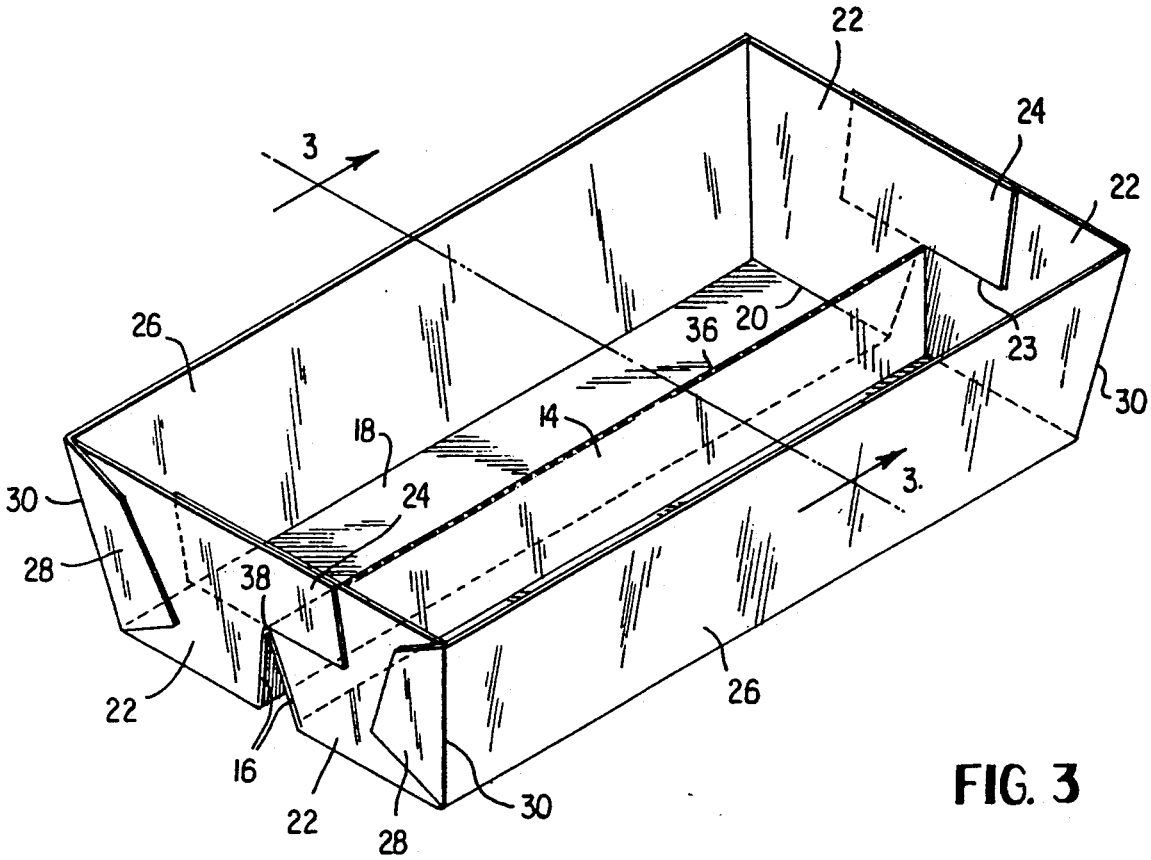
FIG. 2 is a perspective view illustrating the blank of FIG. 1 after it has been erected and set up to form the tray of this invention.

Referring now to FIG. 2 of the drawings, the blank 10 is illustrated as having been erected or set up from its flat configuration. Adhesive has been applied to glue panels 28 and/or legs 24 of end wall forming flaps 22. It will be observed that the upper end of the longitudinal arch, of generally inverted V shape in transverse cross section, formed by first panels 14, extends through the end wall of the tray, each end wall defined by L shaped flaps 22 and glue flaps 28. The top edge of the arch is denoted as 36, while the endmost portions of the arch, which extend through the end walls of the tray, are denoted by 38. The innermost of free edge portions 25 of each end wall forming flap 22 conform to the shape of the arch, each innermost edge 25 lying against a portion of the surface of a respective panel 14. It will further be observed that junctions 27, between free edges 23 and 25 of each end forming panel 22, lie at the top 36 of the inverted V arch. The outermost free edges 29 of each end forming flap 22 are aligned after erection and are coplanar with the tray upper periphery. Portions 24 of flaps 22 overlap and are glued together as part of the tray end walls.

Still referring to FIG. 2, the slope of free edges 16 of panels 14, and that of fold lines 30 of each panel 26 yields a trough having both of its upstanding sides at substantially the same angle with respect to the bottom of the tray, the latter being coplanar with second panels 18.

By virtue of the contact between free edges 25 and junction 27 of each end wall forming flap 22 with corresponding portions of the inverted V arch, not only is erection of the tray from a blank facilitated, but greater rigidity is imparted because of the anchoring action between the central inverted V arch and the end walls of the tray.

Figure 4:
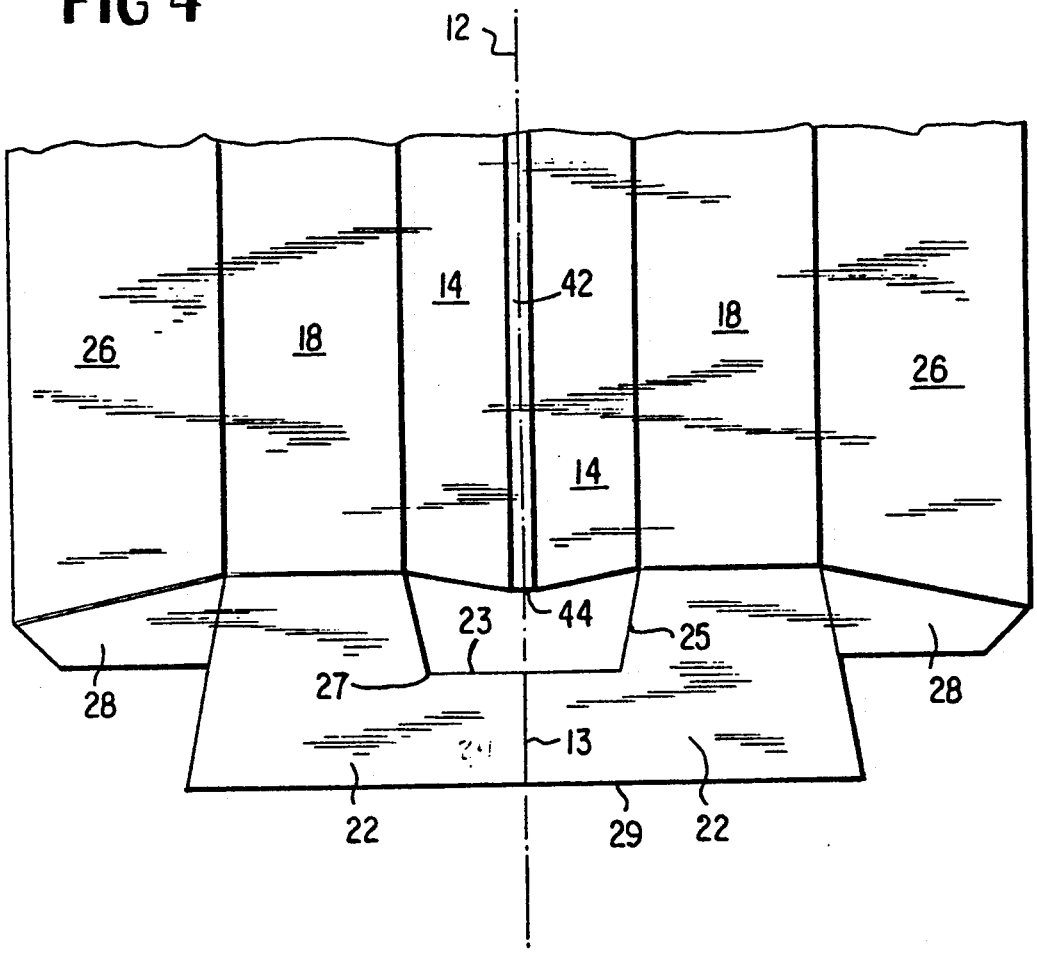
FIG. 4 is a partial plan view of a modification of the blank shown in FIG. 1.

Referring to FIG. 4 of the drawings, the reader will observe that the blank of this embodiment is identical to that shown at FIG. 1, except for the addition of a relatively narrow rectangular strip or bridge panel 42 between the long ends of adjacent trapezoidal first main panels 14, this additional panel having free edges 44 at either end. The longitudinal axis of mirror symmetry passes through the center, longitudinally, of panel 42.

Figure 3:
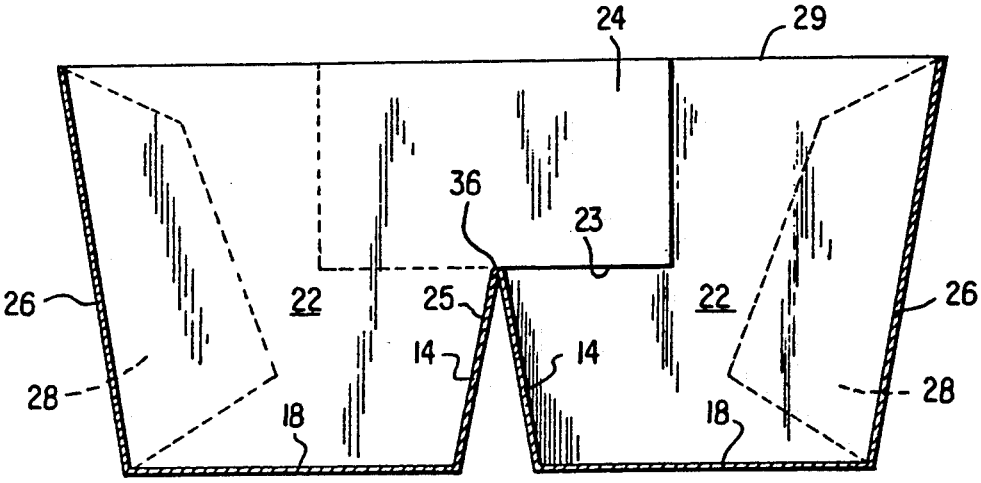
FIG. 3 is a view taken along section 3-3 of FIG. 2.
Figure 5:
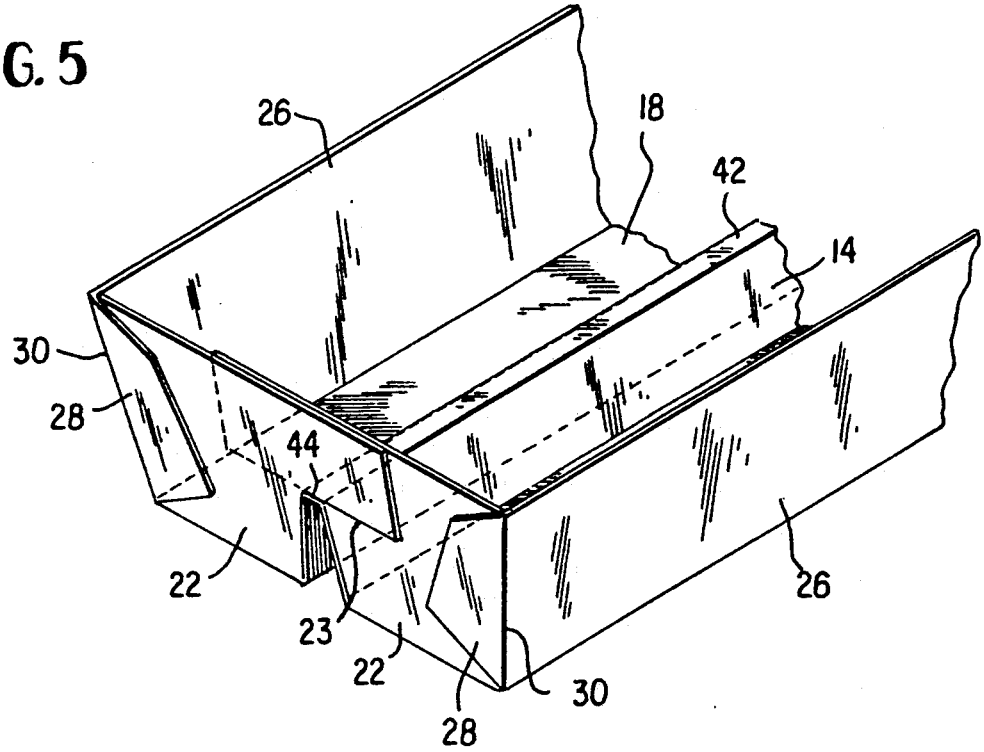
FIG. 5 is a partial perspective view illustrating a tray erected from the blank of FIG. 4.

Referring to FIG. 5 of the drawings, it will be seen that the erection of the blank of FIG. 4 to form the completed tray is the same as that first described, except that here the central arch of generally inverted V shape has been truncated somewhat. Instead of a sharp edge running along the top of the arch, the edge has been flattened out and is now replaced by panel 42. Otherwise, the relationship between the elements of the assembled tray is substantially the same as that described with respect to the tray shown at FIGS. 1–3 of the drawings. The major difference is that the junctions 27 between pairs of free edges 23 and 25, at each end of the tray, abut respective longitudinal edges of panel 42. Thus, the slope of free edges 25 of end forming flaps 22 can be somewhat different than for the blank at FIG. 1. Further, free edges 23 of flaps 22 make line contact with panel 42 adjacent the ends 44 of the inverted, truncated V arch which extend beyond the tray end walls.

Figure 6:
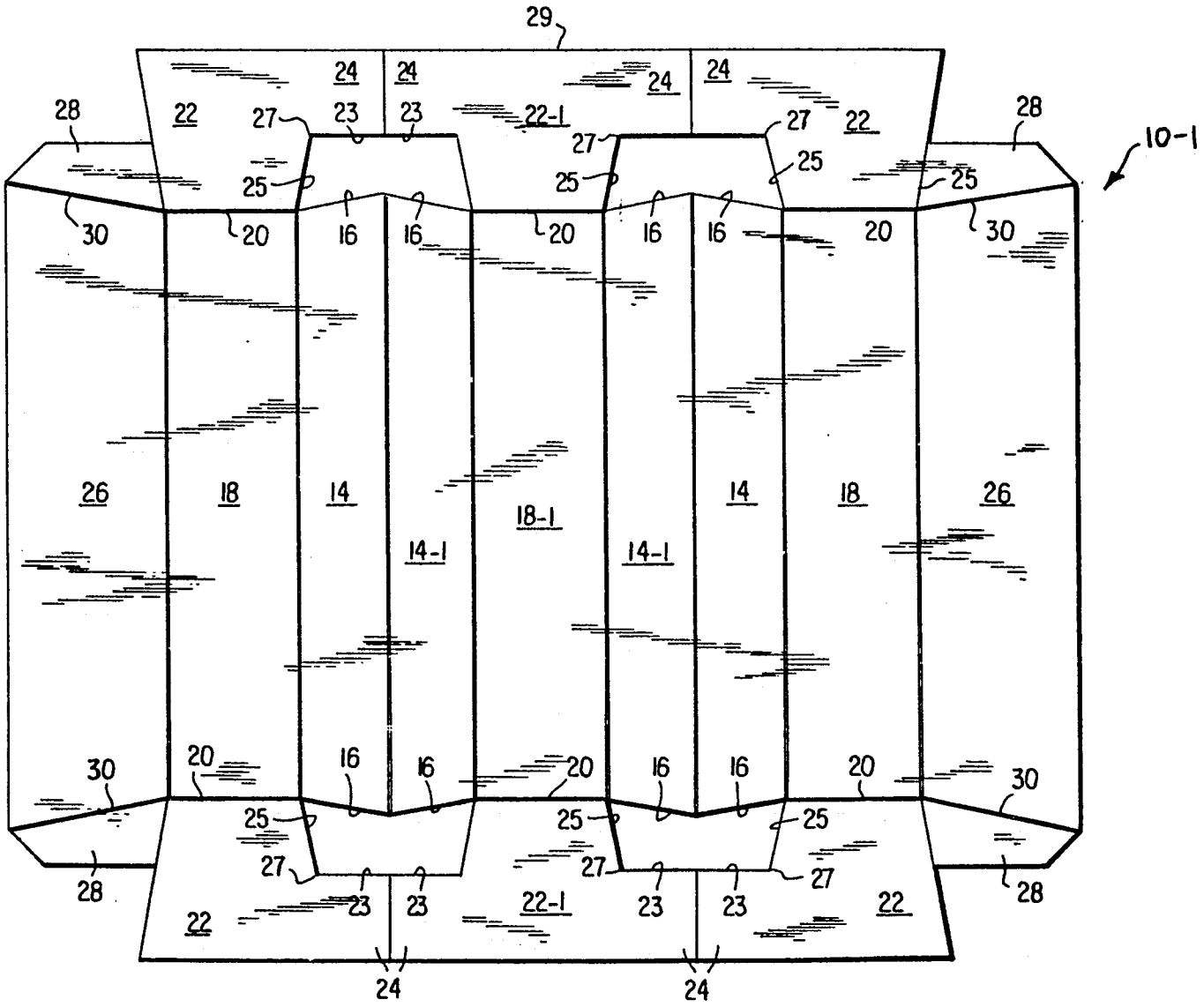
FIG. 6 is a partial plan view of a modification of the blank of FIG. 1, the blank of FIG. 6 producing a tray having three parallel troughs.
Figure 7:
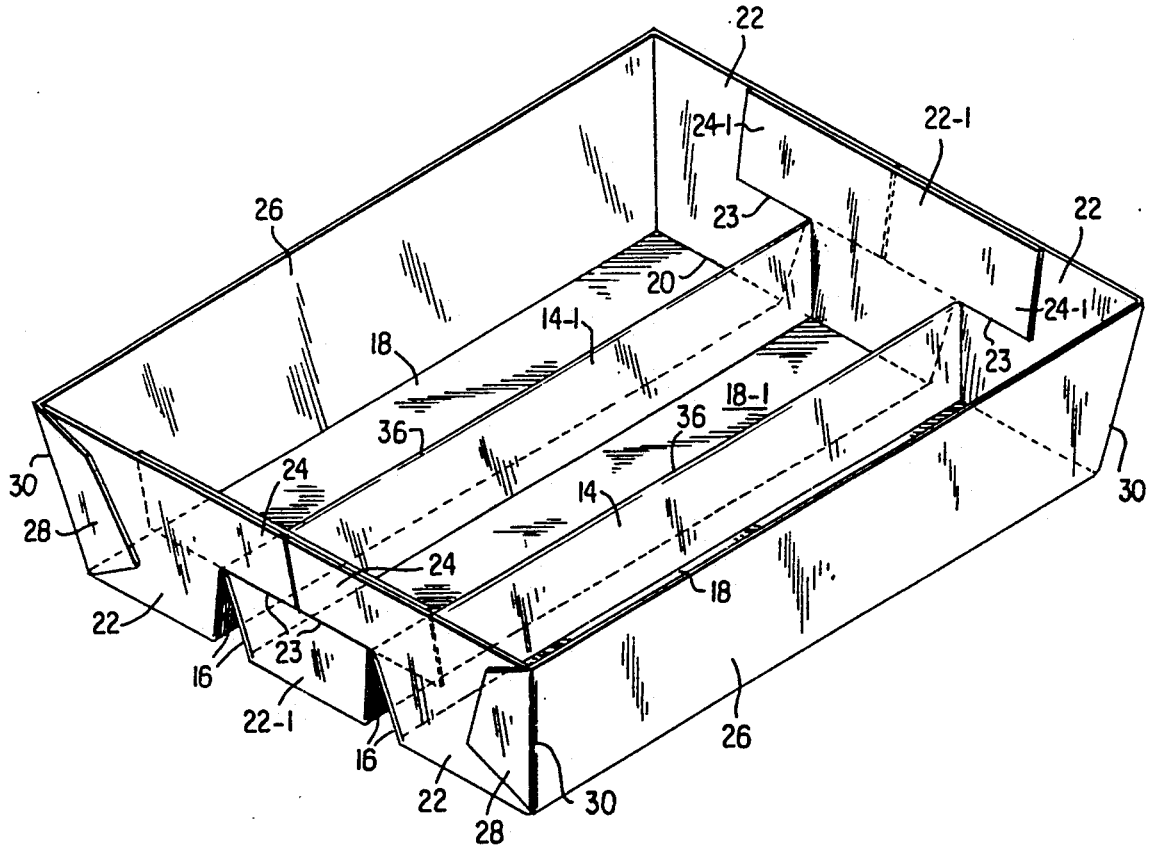
FIG. 7 is a perspective view of the blank of FIG. 6 after it has been erected to form a tray.

Referring now to FIG. 6 of the drawings, a blank 10-1 for forming a tray having three troughs is illustrated. The blank is similar to that of FIG. 1 and bears the corresponding reference numerals for corresponding elements. The middle of blank 10-1 includes another main, rectangular trough bottom forming panel 18-1 and adjacent main panels 14-1, with an angled end wall forming flap 22-1 foldably attached at either end of m in panel 18-1. In this embodiment, the angled end wall flaps carried by intermediate trough bottom forming panels 18-1 are T shaped. The blank is folded and erected as shown at FIG. 7 to form a tray having three parallel troughs, with main panels 18 and 18-1 forming the bottoms of the troughs and main panels 14 and 14-1 forming the several trough sides. As with the assembled trays shown at FIGS. 2, 3 and 5, the upper edges or apices 36 of the two inverted V arches, defined by main panels 14 and 14-1, are contacted by free edges 23 of the end wal forming flaps to rigidify and strengthen the tray end walls.

The blank 10-1 for forming a tray with three troughs may be regarded as similar to the blank 10 of FIG. 1, except for the addition of an intermediate main panel 18-1 between the laterally outermost trough bottom forming panels 18, adjacent trough side forming panels 14-1, and generally T shaped end wall forming flaps 22-1. This is analogous to the addition of rectangular strip 42 to FIG. 1 to obtain the blank of FIG. 4.

The invention may thus be practiced with two or more troughs. If a tray having four or more troughs is desired, it is only necessary to add additional intermediate sections 18-1, 14-1 and associated T shaped flaps 22-1 on either side of trough bottom panel 18-1 shown at FIG. 6. Thus for a tray of six troughs, there would be four sections 18-1, 14-1 and associated T shaped flaps 22-1 in series, and bordered, at each end of the series of panels, by a pair of side forming panels 18 and 26, similar to FIG. 6.

FIG. 7 illustrates the blank of FIG. 6 after erection to form a tray having three parallel troughs. Except for the additional trough, it is similar to that shown at FIG. 3.

I claim:

1. A unitary paperboard blank for making a tray having at least a pair of parallel troughs, the blank including a series of elongated, parallel panels each having parallel, elongated edges and joined by fold lines in series to each other along their elongated respective edges, each panel of at least one adjacent pair of said panels being trapezoidal and having shorter edges, termed free edges, not foldably connected to any of said panels, said pair of trapezoidal panels adapted to form an arch partition between an adjacent pair of parallel troughs, said parallel panels including a pair of generally rectangular, trough bottom forming panels each joined to one of said elongated respective edges of a respective said trapezoidal panel, said trough bottom forming panels having an angled tray end forming flap attached along a fold axis to each shorter edge of the former, one leg of each end wall forming flap being oppositely spaced from one of said free edges of a respective said trapezoidal panel, the free edge of each trapezoidal panel slanting away from the fold axis which joins a trough bottom forming panel to the latter's angled flap, the length of the fold line joining said trapezoidal panels being longer than the length of the fold lines oining any of said trapezoidal panels to its next adjacent said trough bottom forming panel.

2. The blank of claim 1 including two serially outermost, generally rectangular trough side forming panels, each adjacent to and foldably joined to a respective trough bottom forming panel longer edge, each outermost panel having a glue tab foldably joined to each of its shorter ends.

3. The blank of claim 2 wherein each said outermost panel is trapezoidal and wherein the fold joining its glue tab to its respective outermost panel slants at the same angle as the said slant of the free edges of said first recited trapezoidal panel, but in an opposite sense with respect to said fold axis joining one of said trough bottom forming panels to a respective said end wall forming flap.

4. The blank at claim 1 including a relatively narrow, substantially rectangular bridge panel having its longer edges foldably connected to and positioned between the longer sides of said trapezoidal shaped panels.

5. The blank of claim 1 including a second pair of adjacent trapezoidal panels, at least one additional, generally rectangular bottom forming panel foldably connected to and positioned between said first and second pairs of trapezoidal panels, each shorter end of said additional generally rectangular bottom forming panel foldably connected to the vertical base of a T shaped end wall forming flap, a side edge of each top leg of the T shaped extending at least to a projection of a respective fold line joining a respective pair of said trapezoidal panels.

6. The blank of claim 5 including two serially outermost, generally rectangular elongated trough side forming panels, each adjacent to and foldably joined to a respective trough bottom forming panel longer edge, each outermost panel having a glue tab foldably joined to each of its shorter ends.

7. A tray having at least two troughs and formed from a unitary paperboard blank, the tray including a plurality of elongated, parallel panels each having parallel, elongated edges and joined by fold lines to each other along their respective elongated edges, each trough having a bottom panel and two generally upwardly extending generally rectangular side panels, any adjacent pair of said troughs separated and partially defined by an elongated inverted V arch having an apex formed by adjacent pairs of said side panels, each bottom panel having an angled flap at each end which is folded at about a right angle to thereby form opposite end walls of said tray, the apex of said inverted V arch extending through the opposite end walls of the tray, at least at least one of (a) said arch sides, and (b) said apex of said arch, contacting said opposite end walls.

8. The tray of claim 7 wherein said end wall forming flaps partially overlap each other above said arch.

9. The tray of claim 7 including a relatively narrow, substantially rectangular bridge panel foldably connected along its longer sides to and between the longer sides of said inverted V arch panels, whereby the inverted, generally V shaped arch is truncated at its apex, aligned edges of said end forming flaps contacting said bridge panel.

10. The tray of claim 7 wherein said angled end wall forming flaps are generally L shaped.

11. The tray of claim 7 wherein some of said angled end wall forming flaps are generally L shaped and the remainder are generally T shaped.

* * * * *